United States Patent [19]

Deal

[11] Patent Number: 4,762,587

[45] Date of Patent: Aug. 9, 1988

[54] UNIVERSAL TAX STAMPING ASSEMBLY

[75] Inventor: Philip A. Deal, Winston-Salem, N.C.

[73] Assignee: R. J. Reynolds Tobacco Company, Winston-Salem, N.C.

[21] Appl. No.: 99,634

[22] Filed: Sep. 22, 1987

Related U.S. Application Data

[63] Continuation of Ser. No. 760,900, Jul. 31, 1985, abandoned.

[51] Int. Cl.[4] ..... B44C 1/16; B44B 5/00; B65C 9/00

[52] U.S. Cl. ..... 156/542; 156/238; 156/567; 156/DIG. 26; 156/DIG. 33

[58] Field of Search ..... 156/361, 362, 363, 540, 156/541, 542, 458, 567, 568, 448, 446, 230, 234, 239, 242, 249, 360, 379.8, DIG. 25, DIG. 26, DIG. 27, DIG. 33; 101/35, 22, 30, 375, 376, 377

[56] References Cited

U.S. PATENT DOCUMENTS

| | | | |
|---|---|---|---|
| 749,487 | 1/1904 | Kent | 101/375 |
| 3,451,874 | 6/1969 | Solomon et al. | 156/567 |
| 3,669,805 | 6/1972 | Enguoll | 156/567 |
| 3,997,384 | 12/1976 | Kuring et al. | 156/542 |
| 4,263,766 | 4/1981 | Baker et al. | 156/361 |
| 4,500,241 | 2/1985 | Peters et al. | 156/567 |

FOREIGN PATENT DOCUMENTS

| | | | |
|---|---|---|---|
| 2526921 | 12/1976 | Fed. Rep. of Germany | 101/375 |
| 2752819 | 5/1979 | Fed. Rep. of Germany | 156/567 |

*Primary Examiner*—Robert A. Dawson
*Assistant Examiner*—Louis Falasco
*Attorney, Agent, or Firm*—Herbert J. Bluhm

[57] ABSTRACT

A universal tax stamping assembly for applying tax stamp decals to the bottoms of cigarette packs in cartons utilizes a rotatable drum carton conveyor having carton pocket forming inserts. The cartons are placed within the pockets of the rotatable drum which is indexed past one or more tax stamp applying stations. Each station includes a ribbon roll assembly, having a plurality of individual rolls of tax stamp decal carrying ribbons and position adjusting spacers, if necessary. These ribbons are advanced by feed rollers underneath heater bars which transfer the decals to the cigarette packs. Several of these stations can be placed in a serial manner about the periphery of the rotatable drum with each station applying a different tax stamp decal to each cigarette pack. Variations in carton size and pack configuration are accommodated by the universal tax stamping assembly.

7 Claims, 3 Drawing Sheets

UNIVERSAL TAX STAMPING ASSEMBLY

This is a continuation of co-pending application Ser. No. 760,900 filed on July 31, 1985.

FIELD OF THE INVENTION

The present invention is directed generally to a tax stamping assembly for the application of decal tax stamps to cigarette packs while in a carton. More particularly, the present invention is directed to a tax stamping assembly which is readily adaptable to apply tax stamps to cigarette packs in various carton configurations. Most specifically, the present invention is directed to a universal tax stamping assembly that transports cigarette packs in cartons in a rotating drum past one or more tax stamp applying stations. The drum rotates about a horizontal axis and carries cigarette carton receiving pockets sized to retain various sizes of cartons in the drum during rotation. A plurality of tax decal stamp carrying ribbons formed into rolls are placed adjacent the rotating drum. The feed rates of the ribbons of decals and the spacings of the rolls from each other are adjustable so that standard carton configurations as well as various non-standard configurations of cigarette packs in cartons can be tax stamped. Further, a plurality of stamps can be applied to each pack of cigarettes in the carton as each carton is held and transported by the rotatable drum of the universal tax stamping assembly in accordance with the present invention.

DESCRIPTION OF THE PRIOR ART

Many jurisdictions such as state, county, and city governments raise substantial revenues through taxes levied on the sale of cigarettes. To insure that the required taxes have been paid, the appropriate governmental agency sells tax stamps to the wholesale distributor or jobber who must apply one or more of these tax stamps to each pack of cigarettes before it can be sold in a retail outlet. These stamps or transfers have been mounted or attached to long sheets or webs which are formed into rolls and which are sold by the taxing authority to the wholesale distributor or jobber. Because of the wide variety of taxing agencies, the various tax rates, and the inherent distribution problems which would arise, the manufacturer of the cigarettes is not able to apply these local government revenue raising tax stamps to the packages of cigarettes. As indicated above, this task is left to the wholesale distributor whose primary concern is being able to apply the tax stamps or transfers in the most expeditious, least time consuming manner possible.

A standard cigarette carton configuration is one in which ten packs of cigarettes are arranged in a two pack wide by five pack long configuration, usually referred to as a 2×5 pack arrangement. Rolls of tax stamps or decals have typically been supplied by local governments to the distributor or wholesaler in a standard configuration that carries spaced rows, each of which has 15 stamps. Various tax stamp applying machines are known in the art for use in applying selected ones of these stamps to the 2×5 pack carton configuration. Exemplary of these are U.S. Pat. Nos. 4,101,362 to Baker et al; 4,184,305 to Baker et al; and 4,263,766 also to Baker et al, which are assigned to the assignee of the present application and whose disclosures are incorporated herein by reference. These are structured to operate with the standard 15 tax stamp wide rolls of stamps and are apt to be somewhat complex assemblies. They cannot handle cartons having an other than 2×5 pack configuration.

Several recently introduced brands of cigarettes have started a trend away from conventional sizes and pack configurations. For instance, one brand of cigarettes now on the market is thinner or smaller in diameter than prior cigarettes and is longer in length. Due to their smaller diameters, these cigarettes form a smaller pack which, in an effort to maintain a generally standard carton size, requires a 1×10 pack array instead of the conventional 2×5 array. Another brand of cigarettes is sold in a 25 cigarette pack instead of the usual 20 cigarette pack. To again approximate standard carton size, these cigarettes are sold in a 1×9 pack array. Various other non-standard pack configurations and carton sizes, which may be utilized in addition to the presently existing 1×10 and 1×9 configurations, are not stampable with presently available tax stamp applying assemblies.

As was indicated above, the conventional tax stamp roll configuration has been one in which 15 stamps or decals are carried in each row of stamps on the roll. The recently introduced non-standard pack configurations cannot be stamped using these conventional rolls of tax stamps. State and local governing authorities have been highly reluctant to allow the use of different configurations of tax stamp rolls as this requires them to maintain additional inventories of stamp rolls thereby increasing inventory and distribution cost as well as tying up additional capital in various tax stamp decal rolls. The suppliers of tax stamp rolls have also been reluctant to deviate from the standard tax stamp roll configuration, again since such a departure from a single standard roll configuration causes inventory and distribution problems. Finally, the distributors and jobbers do not want to maintain a large inventory of various tax stamp rolls, each usable on only one carton configuration. They would rather charge a premium and hand stamp the various pack configuration.

An increasing phenomenon is that of multiple taxing authorities each levying its own tax on cigarettes. For instance, there may be both a state and county tax or a state and city tax. It is even possible to envision a situation in which a state, county, and municipality would each place separate taxes on cigarette sales. Such an occurrence would most likely require the affixing of multiple different tax decal stamps to the bottom surface of each pack of cigarettes in each carton. Presently available tax stamping machines, particularly those which utilize the standard 15 decal wide rolled web configuration, are incapable of applying more than one stamp to each pack of cigarettes. To accomplish such a stamping in presently available machines requires, at the least, the passage of each carton of cigarettes through the machine a multiple number of times. Each passage of the carton through the tax stamping machine, as would be necessary for the application of multiple different stamps to each pack, substantially increases the risk of carton damage.

Changing cigarette pack sizes, new, non-standard carton sizes and configurations, together with the increasing frequency of the need to apply multiple stamps to each pack of cigarettes have created the need for a tax stamping assembly which is readily usable with various pack sizes and carton configurations, that is quickly modifiable in accordance with various pack sizes and carton configurations, and that is able to apply multiple decal stamps to each pack during one pass through the machine. The universal tax stamping assembly in accordance with the present invention provides such a machine.

SUMMARY OF THE INVENTION

It is an object of the present invention to provide a universal tax stamping assembly.

Another object of the present invention is to provide a tax stamping assembly adaptable to various carton dimensions.

A further object of the present invention is to provide a tax stamping assembly usable with different cigarette pack configurations.

Yet another object of the present invention is to provide a tax stamping assembly utilizing a rotatable drum having cigarette carton receiving pockets.

A still further object of the present invention is to provide a tax stamping assembly which uses a plurality of rolls of single row ribbons of tax decal stamps to tax stamp a variety of cigarette pack configurations.

Still yet another object of the present invention is to provide a universal tax stamping assembly which can apply multiple different tax stamp decals to each pack of cigarettes during one pass of each carton through the assembly.

An even further object of the present invention is to provide a tax stamping assembly which is less abusive of cigarette cartons than presently available tax stamping devices.

As will be discussed in greater detail in the description of the preferred embodiment, which is set forth subsequently, the universal tax stamping assembly in accordance with the present invention utilizes a rotatable drum to carry opened cartons of cigarettes past several stamping stations. The drum is rotatable about a horizontal axis and carries a plurality of pairs of premolded carton retaining pockets which are sized in accordance with the size of the carton carrying the packs to be stamped. Removal of one group of sets of pockets and their replacement with another group of sets having a different size quickly changes the drum's effective size. It is thus a relatively simple matter to convert the drum from one carton size to another merely by substituting different sized pocket sets. These pocket sets have sufficient resiliency to hold the carton within the drum during rotation, but are not too tight so that the cartons can be removed quite easily after stamping.

As the drum revolves, it carries each carton past a plurality of tax stamp decal applying stations. At each of these stations, a heater bar having a plurality of heated platens presses heat releasable tax stamp decals against the bottoms of the cigarette packs in the carton. The tax stamp decals are carried on thin, elongated ribbons, each having a width of only one tax stamp decal and each being provided with indexing perforations. Each ribbon of tax stamp decals is wound into a roll and a plurality of rolls are carried side by side above each tax stamping station. Suitably sized spacer disks may be interposed between adjacent ones of the rolls of tax stamps to properly space the decal rolls so that they correspond with the pack configuration in each carton. The drive means for advancing the stamp rolls can be driven at a selectable speed with respect to the rotational speed of the carton carrying drum to facilitate proper stamping of various carton configurations.

Each roll of tax stamp decals is only one tax stamp in width. The spacing between adjacent rolls of tax stamps is maintained by properly dimensioned spacer disks. Thus the universal tax stamp applying assembly of the present invention virtually eliminates the large and varied inventory requirements of prior stamping machines. The governmental agencies need to sell only one standard one stamp wide roll to the distributor, and the tax stamp suppliers do not have to make a number of non-standard rolls. Various pack spacings and carton configurations can be provided for by using the one stamp wide rolls in conjunction with a set of properly sized spacer disks. The various inventory requirements necessitated by prior carton tax stamping assemblies are eliminated by the subject device.

The use of the rotating carton carrying drum is ideal for a situation where multiple stamps must be applied to each carton. A plurality of similar stamp applying stations are placed about the periphery of the rotating drum in the direction of drum rotating. Thus as the cartons of cigarettes are carried by the drum, they pass the various stamping stations, each of which applies its own stamp to the various packs. Since each carton is continued to be held within the cooperatively sized pocket in the drum as it rotates past the various stamping stations, there is not likely to be any carton damage.

The universal tax stamping assembly in accordance with the present invention is far superior to present devices. It is able to handle a wide range of carton sizes dictated by various pack configurations and sizes. Future carton sizes and pack configurations can also be readily handled by providing additional carton pocket inserts of appropriate sizes. The use of individual tax stamp decal ribbon rolls in conjunction with various width spacer disks provides a simple yet effective means of varying the spacing between adjacent stamps. The placement of plural stamping stations about the periphery of the rotatable drum allows more than one tax stamp decal to be applied or affixed to each pack without requiring any repositioning or handling of the carton. Ease and flexibility of operation as well as minimal carton handling are provided by the universal tax stamping assembly in accordance with the present invention.

BRIEF DESCRIPTION OF THE DRAWINGS

Although the novel features of the universal tax stamping assembly in accordance with the present invention are set forth with particularity in the appended claims, a full and complete understanding of the present invention may be had by referring to the detailed description of the preferred embodiment which is set forth hereinafter, and as may be seen in the accompanying drawings in which:

DESCRIPTION OF THE PREFERRED EMBODIMENT

Figure 1:
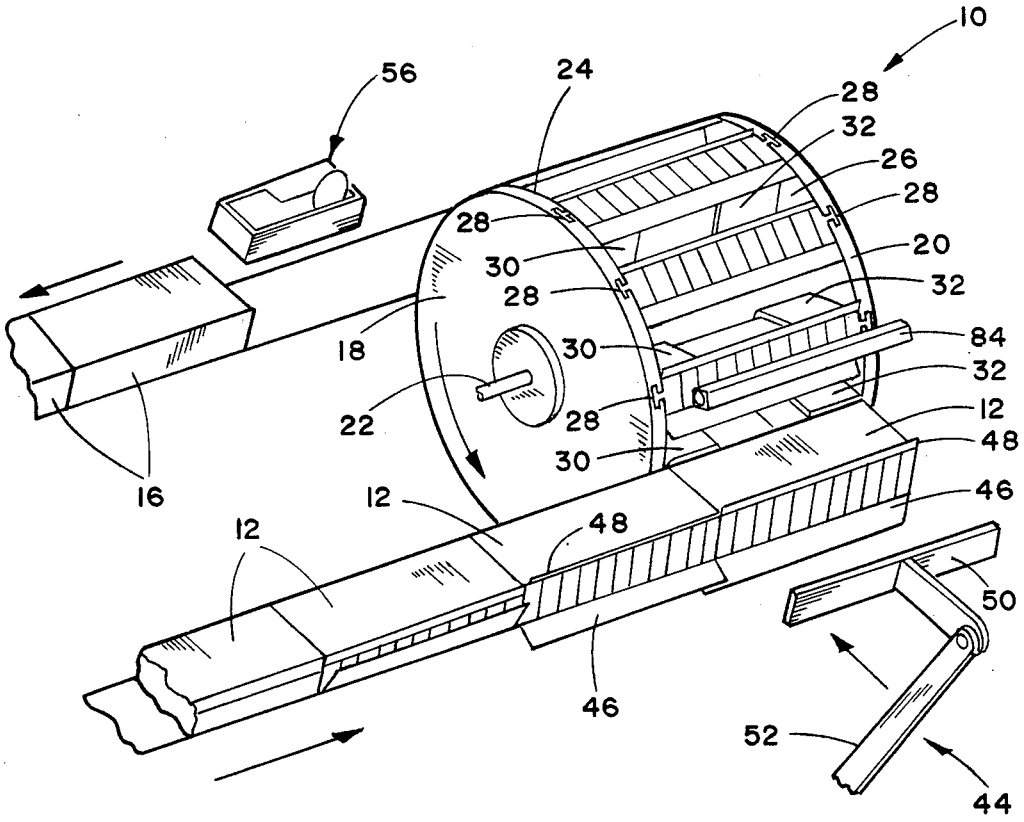
FIG. 1 is a perspective view of the rotatable drum and carton infeed and outfeed portions of the universal tax stamping assembly in accordance with the present invention.

Turning initially to FIG. 1, there may be seen generally at 10 a rotatable drum cigarette carton conveying apparatus which forms a portion of the universal tax stamping assembly in accordance with the present invention. A plurality of cartons of unstamped cigarettes 12 are fed to rotating drum assembly 10. These cartons are placed in rotatable drum 10 and are moved past tax decal stamp applying means generally at 14 in FIG. 2. Tax stamped cartons 16 are taken out of rotating drum assembly 10 and are then conveyed away. During the balance of the discussion of the present invention any reference to tax stamps or tax decal stamps will be understood to mean heat activated decals initially carried by a flexible web and transferred to a cigarette pack bottom by a heater bar having heated platens. While the universal tax stamping assembly in accordance with the present invention is intended primarily for use with these heat activated decals, it could also be used with ink stamp transfers.

Referring again to FIG. 1, rotatable drum carton conveying assembly 10 is comprised of a pair of disk shaped end plates 18 and 20 that are spaced from each other and are both affixed by suitable means to a rotatable central shaft 22. Each disk 18, 20 has an inner face portion 24, 26, respectively, with each face 24, 26 being provided with a plurality of equally spaced, radially extending slots 28. As may be seen in FIG. 1, each slot 28 in face 24 of disk 18 is in angular alignment with a corresponding slot 28 in inner face 26 of disk 20. Thus each cooperating set of slots 28 defines a plane perpendicular to the axis of rotation of drum assembly 10 about shaft 22. Drum assembly 10 may be supported by shaft 22 in any generally known manner with shaft 22 being generally horizontal. Furthermore, suitable drive means such as a stepper motor or the like (not shown) will be connected to shaft 22 and will be operable to rotate drum assembly 10 in an incremental or step wise manner.

Figure 5:
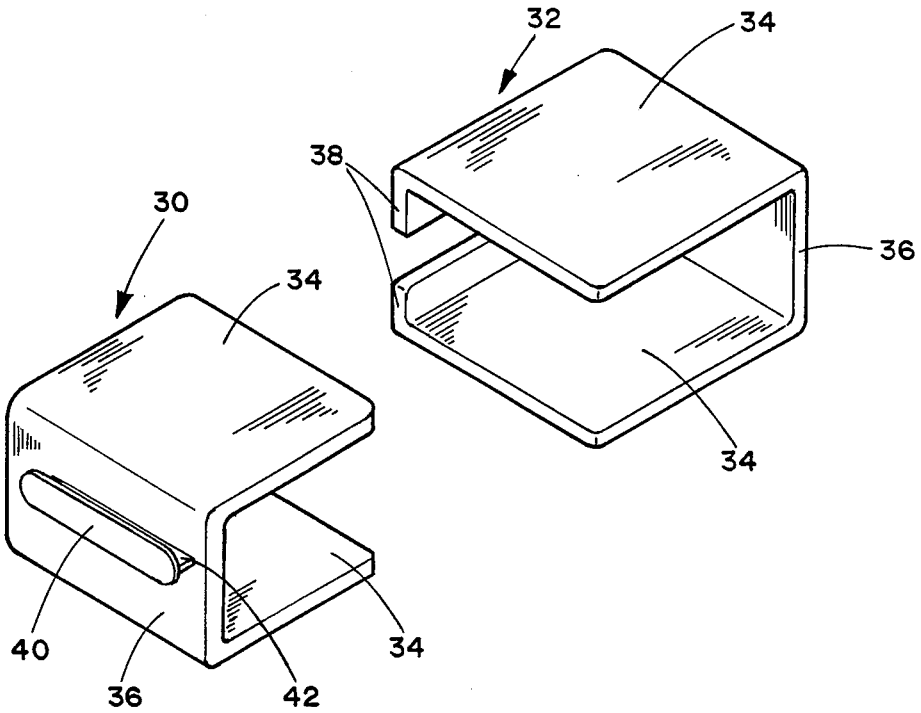
FIG. 5 is a perspective view of a set of carton holding pocket inserts for the rotatable drum of the universal tax stamping assembly in accordance with the present invention.

A set of cigarette carton pocket forming inserts 30 and 32 for use with rotatable drum assembly 10 may be seen in FIG. 5. Each insert 30, 32 has spaced side walls 34 which are joined together by an end wall 36. The plane of each end wall 36 is generally perpendicular to the planes of spaced side walls 34 which are parallel to each other. Partial bottom walls 38, whose planes are perpendicular to both those of side walls 34 and end walls 36 of pocket forming inserts 30 and 32, are formed at one end of each insert 30, 32. Each pocket forming insert 30, 32 carries a mounting flange 40 which is attached to end wall 36 by a connecting web 42. Each such mounting flange 40 is generally parallel to end wall 36 of each pocket forming insert 30, 32. Further, each mounting flange 40 is shaped to be complementary with one of the radial slots 28 in each inner face 24, 26 of disk shaped end plates 18, 20.

Pairs of carton pocket forming inserts 30, 32 are placed in slots 28 in inner faces 24, 26 of spaced end plates 18, 20, respectively, as may be seen in FIG. 1. These inserts 30, 32 are sized in accordance with the dimensions of the cigarette carton 12 which they will receive. They are preferably made of a molded plastic or the like and have sufficient gripping ability to hold the cartons 12 in the rotatable drum carton conveyor 10 while allowing the cartons to be pushed out after stamping. To change the cigarette carton size holding capabilities of the rotatable drum assembly 10, it is merely necessary to slide out one group of pocket forming inserts 30, 32 and to slide in a group of pairs having different side wall, end wall or bottom wall spacings. This adapts the rotatable drum assembly 10 for use with different sized cartons in a quick, expeditious manner.

Each carton 12 of cigarettes to be stamped is fed along a suitable support and conveying assembly (not shown) past a conventional carton flap opening plow (not shown). When a carton reaches a point where it is adjacent a vacant pocket on rotating drum 10, a plunger assembly 44 pushes the carton, whose flaps 46 and 48 have been opened, into the pocket formed by inserts 30 and 32. Plunger assembly 44 is shown as consisting of a generally T-shaped pusher 50 which is pivotably secured to a reciprocable arm 52. It will be understood that this is a somewhat schematic representation of a number of plunger assemblies 44 which could be used to push each open flapped carton of cigarette packs into an empty pocket in rotatable drum assembly 10. After each pack in each carton has been stamped by the tax stamp applying means generally at 14, each stamped carton is pushed out of its pocket in drum 10 by an ejector assembly shown schematically at 54 in FIG. 2. It will be understood that ejector assembly 54 is again a schematic representation of suitable means usable to push stamped cartons 16 out of their pockets in drum 10. Each stamped carton 16 is then passed by a glue applicator 56 of conventional construction, and is taken away from the rotatable drum through a flap closing assembly (not shown).

Figure 2:
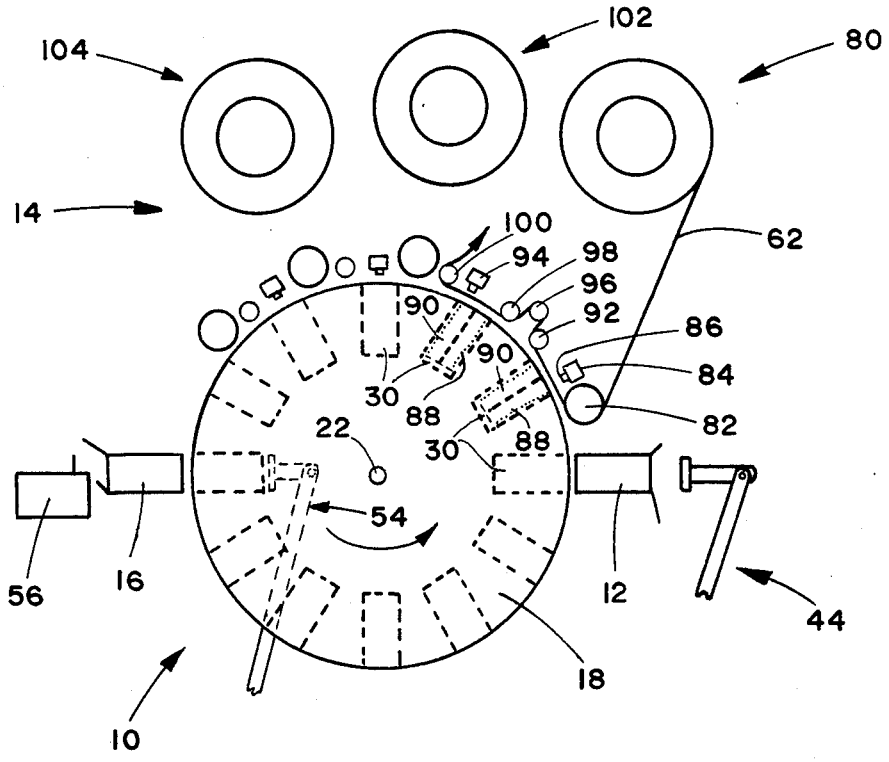
FIG. 2 is a side elevation view of the tax stamping assembly and showing the positioning of the tax stamp applying stations.
Figure 3:
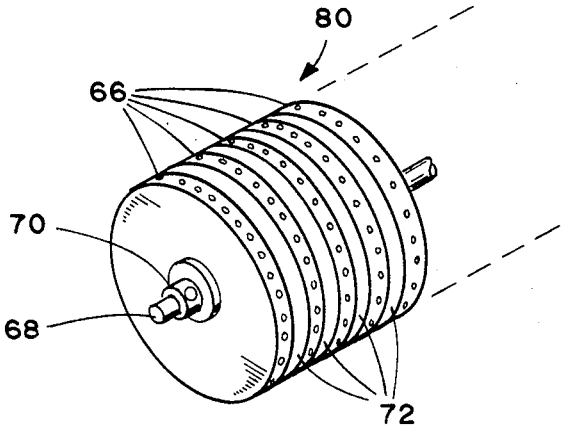
FIG. 3 is a perspective view of a portion of a tax stamp ribbon roll assembly in accordance with the present invention.
Figure 4:
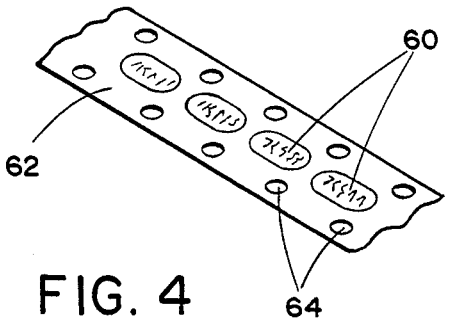
FIG. 4 is a perspective view of a section of a tax decal stamp ribbon for use with the present invention.

Turning primarily to FIG. 2, the tax stamp applying means 14 will now be discussed in detail. Initially, it is essential to recognize that the tax decal stamps themselves are arranged in a configuration which is a departure from the traditional 15 stamps to a row web arrangement. As may be seen in FIG. 4, a single row of decals are positioned in a spaced row on an elongated thin ribbon 62 whose edges are provided with perforations 64 for use in indexing the ribbon into position. Each ribbon 62 of spaced heat activated tax stamp decals 60 is formed into a roll 66 with a plurality of these rolls being rotatably supported on a fixed shaft 68 provided with a suitable shaft collar 70 to keep the rolls 66 on the shaft 68. Depending on the configuration of the cigarette packs in the cartons to be stamped, each roll of tax stamps 66 may be spaced from adjacent rolls 66 by a spacer disk 72. The thickness of each spacer disk 72 will be a function of pack orientation in the carton. For instance, in a standard $2\times5$ configuration, each carton is 5 packs wide. There would thus be 5 rolls of tax stamps 66 with each roll spaced from its adjacent ones by spacers 72 each of which is generally the width of a pack of cigarettes. This would properly space the five rolls 66 along shaft 68. Should the tax stamping assembly be operating instead with cartons having a $1\times9$, $1\times10$, $1\times11$ or similar configuration, each roll of stamps should be spaced so that the distance between decals on adjacent rolls is only one pack thickness. Thus either no spacer disks 72 or quite thin spacers would be required.

Once the appropriate number of rolls 60 of tax stamp decals and spacers 72, if required, have been placed on shaft 68, the so formed first ribbon roll assembly 80 is secured by suitable means for rotation generally above the periphery of rotatable drum carton conveying apparatus 10, as may be seen in FIG. 2. The plural ribbons 62 of tax stamp decals 60 are fed around a first feed roller 82 and between a first heater bar 84 and the periphery of drum assembly 10. Heater bar 84 includes a series of heated platens 86, each of which is positioned to contact a tax stamp decal and to apply it to a pack in a carton 12. One such heater bar 84 may also be seen in FIG. 1 extending above a carton of cigarettes 12 carried in drum 10 by pocket forming inserts 30 and 32. In the orientation of FIG. 1, in which the carton shown has a 1×11 orientation, the heater bar 84 would have 11 platens and 11 ribbons would be supported on ribbon roll assembly 80. By contrast, in the array shown in FIG. 2, each carton is a 2×5 array with each carton 12 being two packs wide. These two packs 88 and 90 are indicated by dashed lines in FIG. 2.

In a one pack carton array as shown in FIG. 1, the tape ribbon 62 is driven by first drive roller 82 and by a second drive roller 92, placed downstream of the heater bar 84, at a linear speed the same as the peripheral speed of drum 10. In this way as drum 10 indexes an unstamped carton under heater bar 84, a new decal 60 to be applied is advanced under heater bar 84 which reciprocates in a known manner to transfer the decal 60 from the ribbon 62 to the bottom of the cigarette pack. In contrast, in the two pack carton orientation shown in FIG. 2, two heater bars, consisting of first heater bar 84 and a second similar heater bar 94, are used. First heater bar 84 is positioned to contact the bottom of pack 88. The tape ribbon is fed under first drive roller 82, under first heater bar 84, under second drive roller 92, over an idler roller 96 and under a third and fourth feed roller pair 98 and 100, respectively, placed on either side of second heater bar 94. In the two pack carton configuration, the decal carrying tape ribbons 62 are driven at twice the peripheral speed of drum 10. This allows the ribbons to advance so that every other decal 60 is applied to a first pack 88 by first heater bar 84 while the alternate decals 60 are applied to a second pack 90 by second heater bar 94.

When it is necessary to apply additional tax stamp decals to each pack, as would be the situation in which multiple taxing authorities have levied taxes on the sales of cigarettes, second and, if necessary, third ribbon roll assemblies 102 and 104, respectively, are provided above the periphery of rotatable driven carton conveying apparatus 10, as may be seen in FIG. 2. Additional drive roll pairs and heater bars are also provided adjacent the periphery of drum 10. These additional ribbon roll assemblies, drive rollers, and heater bars operate in a manner similar to the first described ribbon roll assembly 80 and its coordinated drive rolls and heater bar or bars to apply additional tax stamp decals to the bottom of each pack of cigarettes in each carton as the drum supported cartons are indexed past the heater bars.

In operation, the carton configuration to be stamped such as 2×5 or 1×10 is first determined as are the number of different tax stamp decals to be applied to each pack. The required ribbon roll assemblies 80 are then made up using the appropriate number of individual rolls 66 of stamp ribbons 60 and the correct thickness spacers 72, if needed. Pairs of carton pocket forming inserts 30 and 32 are selected in accordance with the overall carton dimensions and these are attached to the inner faces 24 and 26 of the drum's end plates 18 and 20. Heater bars having properly oriented platens are installed and the drive speed of the various drive rollers is selected in accordance with the pack configuration; i.e., a drive speed equal to the drum peripheral speed for a 1 pack configuration and a drive speed twice that of the drum peripheral speed in a 2 pack configuration. It will be understood that such drive speed selections can be accomplished by any means known in the art, which means is not a part of the subject invention. It will further be understood that the indexing drive of drum 10 is accomplished in a conventional manner as is the coordination of the carton inserting plunger 44, the carton ejector assembly 54, the indexing drive of the drive rollers together with the reciprocation of the various heater bars. As the drum assembly 10 indexes one step, the ribbons also are advanced. When the drum assembly 10 stops, the heater bars lower to transfer decal stamps 60 to the cigarette pack bottoms. At the same time, an unstamped carton 12 is placed in an empty pocket by plunger assembly 44 while a stamped carton 16 is pushed out of its pocket by ejector 54. The cycle then repeats itself to apply one or more stamps to the bottoms of cigarette packs in cartons. Various carton sizes are accommodated for by proper selection of carton pocket forming inserts and various pack in carton configurations are handled by proper spacer utilization and by use of a ribbon feed roller drive speed either the same as or twice that of the peripheral speed of the rotatable drum carton conveying apparatus 10.

While a preferred embodiment of a universal tax stamping assembly in accordance with the present invention has been fully and completely set forth hereinabove, it will be obvious to one of skill in the art that a number of changes in, for example, the specific drive and indexing means, the number of pockets formed in the rotatable drum, the glue applicator, the carton flap opening and closing means, and the like could be made without departing from the true spirit and scope of the present invention which is accordingly to be limited only by the following claims.

What is claimed:

1. A tax stamping assembly for use in applying tax stamp decals to packs of cigarettes contained in cartons, said tax stamp applying assembly comprising in combination:

(a) a rotatable carton conveying drum having a plurality of carton receiving pockets spaced evenly about its periphery;

(b) means for sizing said carton receiving pockets in accordance with the overall dimensions of the cartons being conveyed by said drum;

(c) at least a first tax stamp applying station positioned adjacent the periphery of said rotatable carton conveying drum intermediate a carton insertion means and a carton ejector means, said station adapted to simultaneously apply a stamp to each of a plurality of cigarette packs in each of said cartons by the application of heat to a plurality of decal-carrying ribbons;

(d) at least one tax stamp ribbon roll assembly that includes a shaft for removably accepting and rotatably supporting a plurality of decal-carrying ribbons and spacer means for maintaining said plurality of decal-carrying ribbons in a predetermined spaced relationship as they are moved to said tax stamp applying station; and (e) means associated with said tax stamp applying station for simultaneously moving each of said decal-carrying ribbons to said tax stamp applying station and into position adjacent the periphery of said rotatable carton conveying drum.

2. The tax stamping assembly of claim 1 wherein said at least first stamp applying station includes a reciprocable heater bar having a plurality of tax stamp decal applying platens, said platens being engageable with said decal-carrying ribbons to apply said tax stamp decals to said cigarette packs.

3. The tax stamping assembly of claim 1 wherein said at least one tax stamp ribbon roll assembly includes a plurality of individual rolls of decal-carrying ribbons of tax decal stamps spaced from each other on said shaft by removable, interposed spacer disks, the number of individual rolls and the thickness of the spacer disks removably supported by said shaft being determined by the configuration and size of the cigarette packs in said cartons.

4. The tax stamping assembly of claim 1 wherein said rotatable carton conveying drum is rotatable about a generally horizontal axis.

5. The tax stamping assembly of claim 1 further wherein a second tax stamp applying station is positioned adjacent the periphery of said rotatable carton conveying drum intermediate said first tax stamp applying station and said carton ejector means.

6. The tax stamping assembly of claim 5 wherein said second tax stamp applying station is simultaneously supplied with a plurality of decal-carrying ribbons of tax decal stamps by a second tax stamp ribbon roll assembly.

7. The tax stamping assembly of claim 1 wherein said means for simultaneously moving each of said decal-carrying ribbons includes means for engaging perforations in said decal-carrying ribbons and thereby controlling the indexing movement of said decal-carrying ribbons.

* * * * *